US006435573B1

(12) United States Patent
Szablewski

(10) Patent No.: US 6,435,573 B1
(45) Date of Patent: Aug. 20, 2002

(54) ROTATING CATCH LOCK, SPECIALLY FOR MOTOR VEHICLES

(75) Inventor: Piotr Szablewski, Wuppertal (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 09/446,349

(22) PCT Filed: Jun. 12, 1998

(86) PCT No.: PCT/EP98/03564

§ 371 (c)(1),
(2), (4) Date: Mar. 13, 2000

(87) PCT Pub. No.: WO98/58146

PCT Pub. Date: Dec. 23, 1998

(30) Foreign Application Priority Data

Jun. 17, 1997 (DE) ..... 197 25 416

(51) Int. Cl.[7] ..... E05C 3/06

(52) U.S. Cl. ..... 292/201; 292/216; 292/DIG. 23; 70/277; 70/275; 70/264

(58) Field of Search ..... 292/201, 216, 292/DIG. 23; 70/277, 275, 264

(56) References Cited

U.S. PATENT DOCUMENTS 4,518,180 A * 5/1985 Kleefeldt et al. ..... 292/201
4,948,184 A * 8/1990 Weyerstall et al. ..... 292/216
5,020,838 A * 6/1991 Fukumoto ..... 292/201
5,697,237 A * 12/1997 Dilger et al. ..... 70/264
5,802,894 A * 9/1998 Jahrsetz et al. ..... 70/264
5,934,717 A * 8/1999 Wirths et al. ..... 292/201
5,938,252 A * 8/1999 Uemura et al. ..... 292/201
5,938,253 A * 8/1999 Szablewski et al. ..... 292/201
5,979,951 A * 11/1999 Shimura ..... 292/216
5,992,194 A * 11/1999 Baukholt et al. ..... 70/279.1
6,000,257 A * 12/1999 Thomas ..... 70/279.1
6,056,334 A * 5/2000 Petzold et al. ..... 292/216
6,076,868 A * 6/2000 Roger, Jr. et al. ..... 292/201
6,089,626 A * 7/2000 Shoemaker ..... 292/201
6,116,664 A * 9/2000 Wegner ..... 292/216
6,148,651 A * 11/2000 Roncin ..... 70/264
6,155,124 A * 12/2000 Wirths ..... 292/201
6,338,508 B1 * 1/2002 Kleefeldt ..... 292/201

* cited by examiner

*Primary Examiner*—Anthony Knight
*Assistant Examiner*—Matthew E. Rodgers
(74) *Attorney, Agent, or Firm*—Friedrich Kueffner

(57) ABSTRACT

The invention relates to a rotating catch lock, wherein a closing member (10) interacts with a catch (20), which can be rotated between a closing position accommodating the closing member (10) and an open position which releases said member. The catch (20) is force-loaded (22) in an open position and is held by a spring-loaded (33) rotating latch (30) in the close position. Said latch (30) is moved by a motor (50) between the locking position retaining the catch (20) and a stand-by release position in which the spring-loaded latch (30) is propped up by the catch (20) as long as it remains in an open position. In order to use small compact motors (50), the invention provides that the stored energy (61) exerted by an energy storage mechanism (60) is transmitted to the latch (30) via a storage lever (40). Normally, the latch (30) is shifted into its stand-by position by the storage lever (40). When the latch (30) is in a stand-by position, the storage lever (40) is supported on a control tappet (51) which is rotationally driven by the motor (50). The motor (50) can be driven by an electrical control logic in both a forward mode (56) unloading the energy storage (60) and a reverse mode (56') loading the energy storage (60), i.e. in opposite directions. In the reverse mode (56') the control tappet (51) releases the latch (30), moves towards the storage lever (40) and guides it back into a starting position which corresponds to the stand-by position of the latch (30).

9 Claims, 6 Drawing Sheets

ROTATING CATCH LOCK, SPECIALLY FOR MOTOR VEHICLES

BACKGROUND OF THE INVENTION

1. Field of the Invention

The invention pertains to a rotary catch lock of the general type indicated in the following. After being rotated into its end position, that is, its closed position, the rotary catch accepts a closing element; this closed position is maintained by a spring-loaded, pivoting latch. In this situation, the latch is in its locking position. When the latch is moved into a release position to release the rotary catch, the rotary catch can then be moved by a restoring force back into its other rotational end position, namely, the open position, where it releases the closing element. As the catch moves into this open position, the spring-loaded latch is moved into a stand-by position, in which it rests against the open rotary catch. The latch is thus ready to move back into its locking position or pre-catch position with respect to the rotary catch when the rotary catch is rotated back into its closed position or into a previous pre-catch position. A motor and an energy storage mechanism are used to move the latch from one position to the other. Provided that the user has been granted access, the motor starts to operate as soon as the handle belonging to the rotary catch lock is operated.

2. Description of the Related Art

In the known rotary catch lock (DE 4,221,671 A1), the motor serves only to move the latch from its locking position, in which it holds the rotary catch, to a release position, in which it releases the rotary catch, whereas an energy storage mechanism, which serves as a restoring spring to return the driver which serves to move the latch, is used to move the latch into a stand-by position in preparation for the future locking position. In the known lock, the energy storage mechanism discharges its energy while the rotary catch is in its release position and thus moves the driver back into a starting position corresponding to the locking position of the rotary catch, whereas the latch initially remains in its stand-by position with respect to the rotary catch, which is still in the open position.

The disadvantage of the known rotary catch lock is the relatively large amount of power required to operate the motor. The motor must consume energy not only to shift the positions of the latch and the associated working elements, i.e., to move them from the locking position to the release position, but also to load the energy storage mechanism, so that, after the motor has been turned off, the mechanism has enough energy to move the driver that controls the latch back into its starting position. When the known rotary catch lock is used in a motor vehicle and the vehicle is involved in a crash, the various components of the lock are deformed, and thus more energy is required to move the latch from the locking position to the release position; if the motor is not powerful enough, it will be unable to operate the rotary catch lock, and the occupants will be trapped in the vehicle. The known rotary catch locks require powerful motors, which are not only expensive but also very bulky. This is a problem because of the limited amount of room available in the area of a rotary catch lock.

SUMMARY OF THE INVENTION

The invention is based on the task of developing a reliable rotary catch lock of the aforementioned general type which can be operated by a low-power motor and which remains functional even after a crash. This is achieved according to the invention in that the energy storage mechanism acts on a pivoting lever (storage lever), which transfers the stored energy to the latch in order to pivot it into its release position, this energy transmission occurring at least during the final phase of the pivoting motion of the latch under the action of the energy being unloaded from the energy storage mechanism; whereas, while the latch is in the stand-by position and during the initial phase of the pivoting motion of the storage lever, the storage lever rests against a tappet, which is driven rotationally by the motor; and in that the motor can be driven by electronic control logic in either direction of rotation to either of two end positions; that is, either in the forward direction to allow the energy stored in the energy storage mechanism to be unloaded, during which the tappet follows or supports the pivoting motion of the latch under the action of the storage lever, or in reverse to reload the energy storage mechanism, during which the tappet releases the latch, moves toward the storage lever, and moves it into a starting position corresponding to the stand-by position of the latch.

First, the invention shifts the loading of the energy storage mechanism by the motor into a time phase different from the reversing movement by which the latch leaves its blocking position and returns to its release position with respect to the rotary catch. The latch is returned while the motor is operating in the forward direction, whereas the energy storage mechanism is now loaded while the motor is operating in reverse. The energies required for these two measures are therefore not additive but separate, and this makes it possible to use low-power motors. Such motors are inexpensive and space-saving.

In addition, the energy storage mechanism acts on a special pivoting lever, which, while the energy storage mechanism is being loaded during the reverse operation of the motor, is moved by a tappet into a starting position which corresponds to the stand-by position of the latch. Because the energy storage mechanism is being loaded during this movement, this lever is referred to in brief below as the "storage lever". While the motor is in forward drive, the tappet normally acts only with a braking action during the initial phase of the pivoting motion of the storage lever, i.e., in the phase before the storage lever strikes an adjusting arm belonging to the latch. In this second phase, the energy being released by the unloading of the energy storage mechanism can be used to help move the latch. In a special case, which can be the result of a crash, for example, the tappet pushes against an adjusting arm provided on the latch and thus helps to shift the latch out of its locking position into its release position. In cases such as this where the components cannot move easily, two different energy sources are therefore available: first, the energy of the loaded energy storage mechanism, which is being released by way of the storage lever, and, second, and energy of the motor operating in the forward direction, which acts directly on the latch by way of the tappet. Thus the energies supplied by the motor in two different phases of its operation can be utilized simultaneously to move the latch.

BRIEF DESCRIPTION OF THE DRAWINGS

Additional measures and advantages of the invention can be derived from the claims, from the following description, and from the drawings. The invention is explained in greater detail below with reference to the drawings, which show an exemplary embodiment and a suggested alternative:

FIG. 9 shows the positions and locations of the latch and the catch for the special case in comparison with those of normal operations shown in FIGS. 4 and 5;

DESCRIPTION OF PREFERRED EMBODIMENTS

Figure 1:
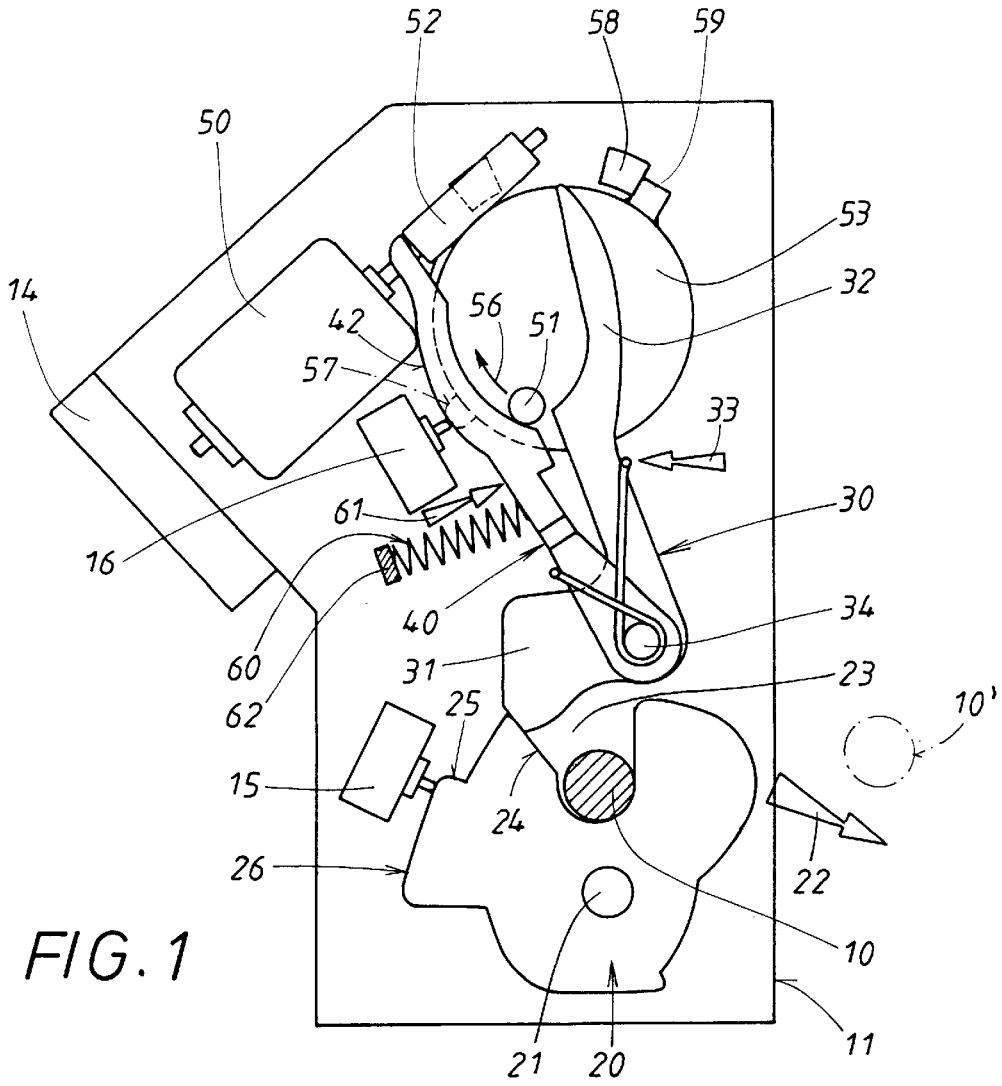
FIG. 1 shows a top view of the catch lock according to the invention while the latch is in a blocking position, in which it holds the rotary catch in its closed position.
Figure 3:
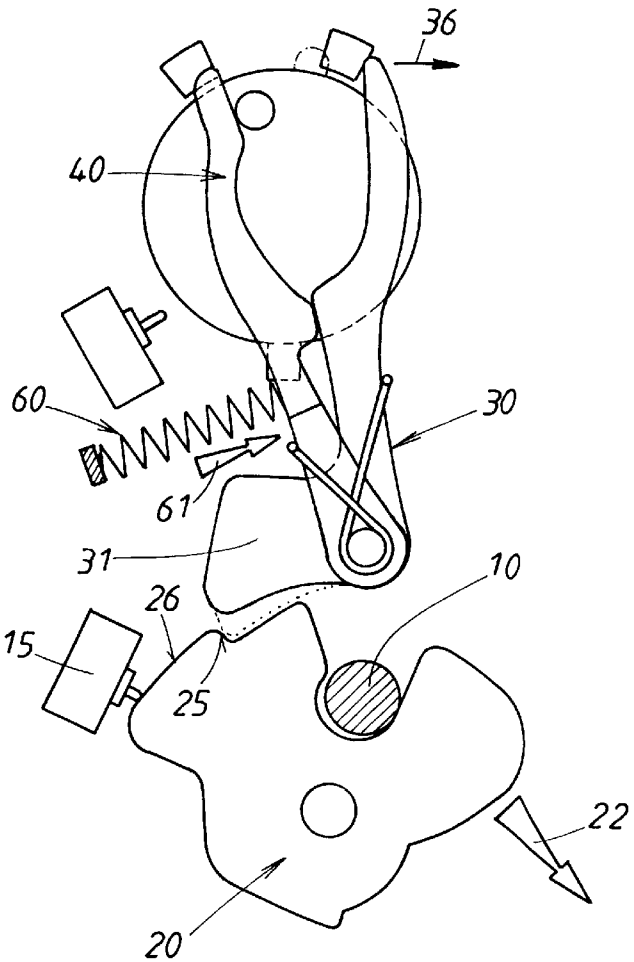
FIGS. 2–4 show the various other positions of the latch and the working positions of the rotary catch up to and including its open position on the basis of the most essential components of the catch lock shown in FIG. 1; the other components shown in FIG. 1 would have to be added here for the sake of completeness.
Figure 2:
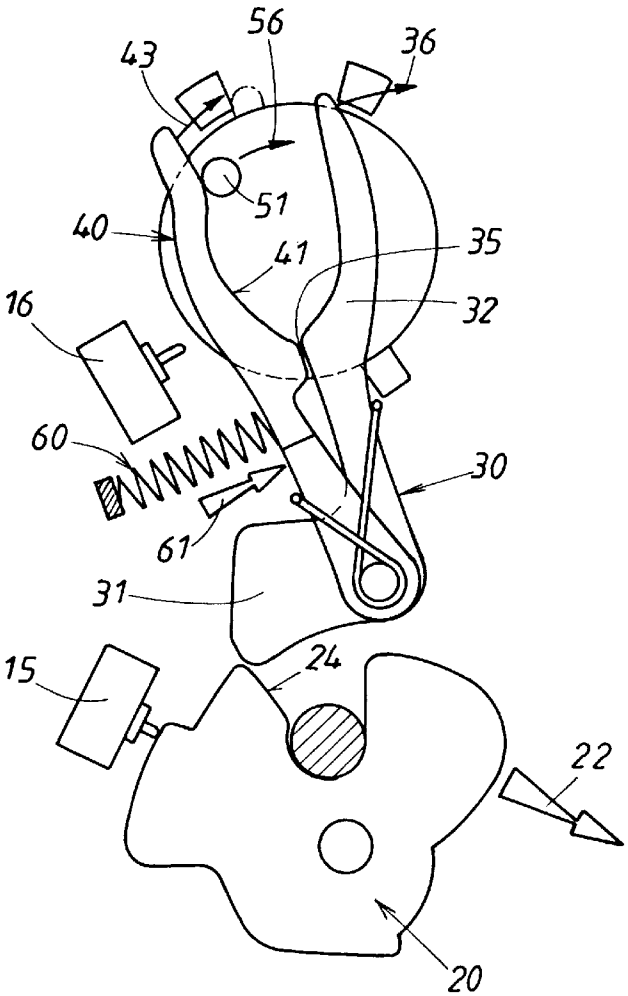
Figure 4:
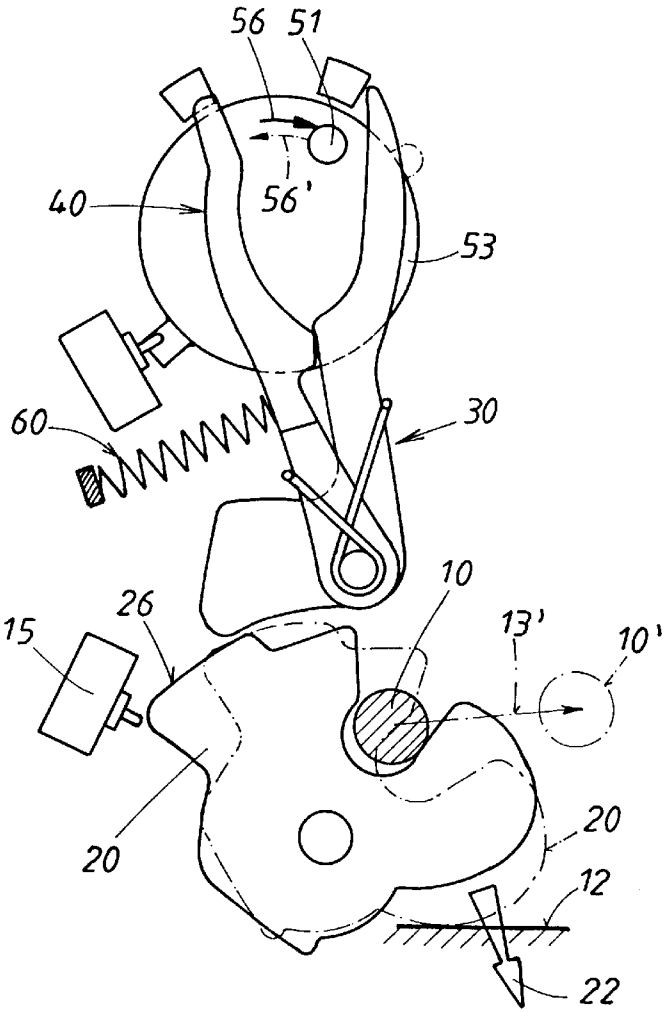

The rotary catch lock comprises a closing element 10, designed here as a bolt, which is attached permanently to a stationary door post of a motor vehicle body and which is emphasized by shading in the figures for the sake of clarity. The other components of the rotary catch lock are installed in a housing 11 of a movable motor vehicle door, to which a rotary catch 20 in particular belongs. Rotary catch 20 can be rotated between two end positions, one of which is shown in FIG. 1, the other in FIG. 6. In between these two end positions there are several other important intermediate positions, which are shown in FIGS. 2–4. The rotary catch is seated on an axle 21 and is subject to a restoring force acting upon it, which can arise in various ways and which is illustrated by a force arrow 22 in the figures. Restoring force 22 tries to rotate rotary catch 20 into the rotational end position shown in FIG. 6, where it is held in a defined position by a stop 12.

Figure 5:
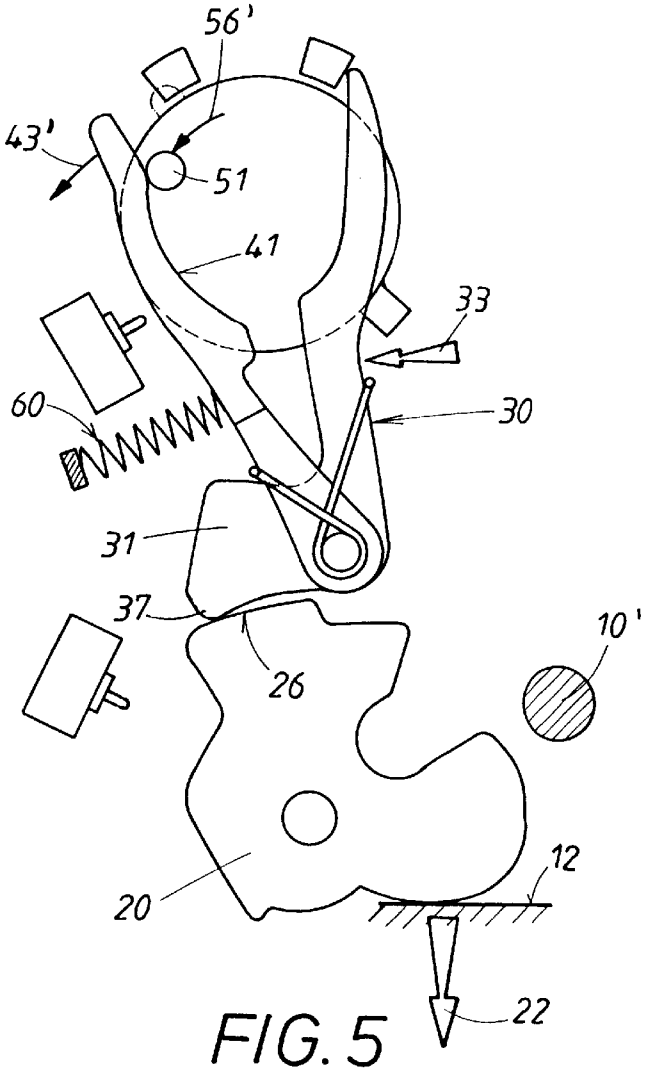
FIGS. 5 and 6 show the return motion of the essential components of the rotary catch lock leading to the stand-by position of the spring-loaded latch on the rotary catch, which is still in its open position.
Figure 6:
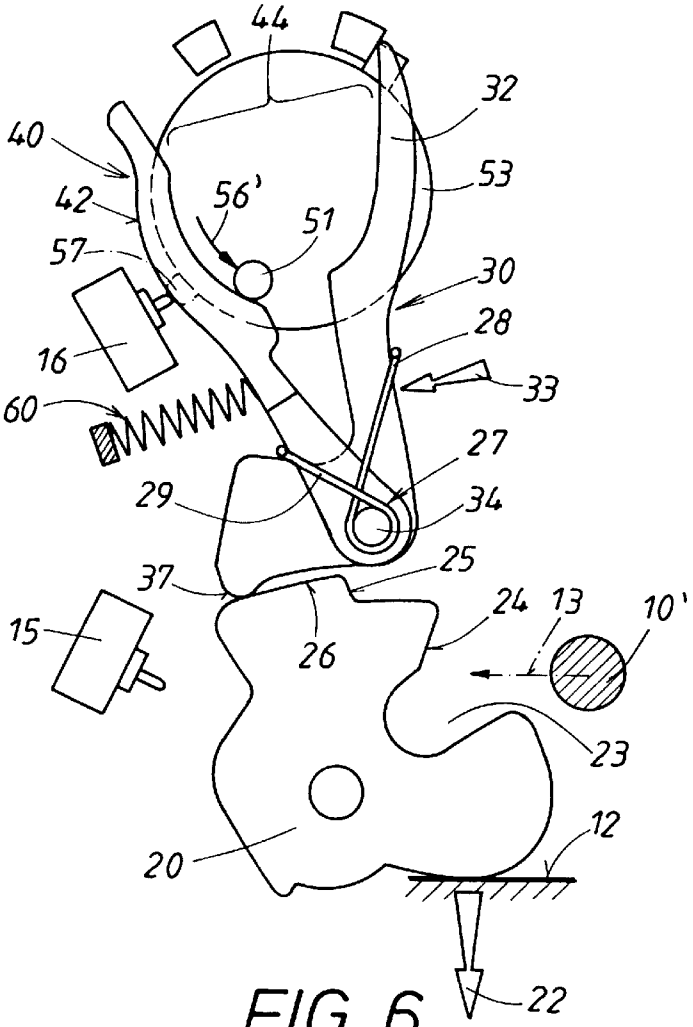

The rotary catch has a shaped radial cutout 23, into which, when the vehicle door is closed in the direction of the closing motion arrow 13 shown in FIG. 6, the closing element 10 enters and holds the catch 20 in the rotational end position shown in FIG. 1. The motor vehicle door is now shut, for which reason the position of the rotary catch 20 shown in FIG. 1 is referred to as the "closed position". When the rotary catch 20 rotates to the other rotational end position, which is suggested in dash-dot line in FIG. 4, the closing element 10 is released, and it is possible for relative motion to occur between the closing element and the door in the direction of the motion arrow 13' shown in FIG. 4. The closing element is now free and can be moved from the closed position 10 in the cutout 23 of rotary catch 20 into its release position 10'. Thus the rotational end position of the catch 20 shown in FIGS. 5 and 6 is called the "open position".

Another component of the lock is a latch 30, designed here with two arms 31, 32; it is mounted in a pivoting manner on an axle 34 in housing 11. One arm 31 of latch 30 cooperates with rotary catch 20 and is therefore referred to as the "working arm", whereas the other arm 32 is used to adjust the various positions of the latch 30 and is therefore referred to below as the "adjusting arm". Latch 30, as can be seen from the force arrow 33 of FIG. 1, is acted on by a spring, which tries to push the working arm 31 elastically against the rotary catch 20. In the closed position of FIG. 1, the working arm 31 of the latch engages with a first flank 24 of the rotary catch 20 and thus holds it against its restoring force 22. In FIG. 1, latch 30 is therefore in a position in which it effectively blocks any movement, for which reason this is referred to in brief below as the "blocking position".

This flank 24 is produced by providing the previously mentioned radial cutout 23 for the closing element 10 with a suitable shape. In the exemplary embodiment shown, a similar retaining effect would also be obtained in an intermediate position of the rotary catch, which can also be seen in FIG. 3, if the working arm 31 of the latch 30, in contrast to what is shown in the diagram, were able, after it had been released, to engage with another flank 25 of the rotary catch 20 set back even farther, as illustrated in dotted line in FIG. 3. In this case, closing element 10 would again be caught in the radial cutout 23 of rotary catch 20. The rotary catch 20 would now be in a "pre-catch position". Thus, the previously described flank 24, which performs its function when the rotary catch 20 is in the completely closed position as shown in FIG. 1, is called the "main catch flank". It is obvious that it would also be possible to define yet other intermediate positions of the rotary catch by providing additional flanks of appropriate design on the rotary catch 20, against which the working arm 31 of the latch would fall with a blocking action in order to secure the catch 20 in the rotational position reached at that point.

A direct-current motor 50, which serves to rotate a tappet 51 by way of a set of gears 52, 53, is also provided in the lock housing 11. In the present case, a worm 52 is mounted on the motor shaft; this gear engages with a worm wheel 53. Motor 50 is connected via a central control 14 to a control logic circuit (not shown in detail) by its two lines designated 54 and 55 in the schematic circuit diagram of FIG. 10; the way in which the logic circuit works will be explained again in greater detail on the basis of the control program of FIG. 11. There are two additional electrical components 15, 16 (sensors) in the housing 11, which are also connected via central connector 14 by lines 17–19 shown in the circuit diagram of FIG. 10. These components also cooperate with the control logic and consist of sensors 15, 16, which, in the present case, are microswitches. Because one sensor 15 cooperates with the catch 20, it is referred to in brief below as the "catch sensor", whereas the other sensor 16 is referred to analogously as the "lever sensor", because it cooperates with a lever 40, which will be fully described below.

Lever 40 is mounted on the same axle 40 as latch 30 and is thus acted on by energy storage mechanism 60. The storage mechanism 60 exerts a stored force acting in the direction of arrow 61 of FIG. 1 on the lever 40, for which reason this is referred to in brief as the "storage lever". In the embodiment illustrated here, the energy storage mechanism 60 is designed as a compression spring, one end 62 of which is supported permanently in housing 11, whereas the other end of the spring is free to act on storage lever 40. In the closed position of the rotary catch of FIG. 1, the storage lever rests against the tappet 51, for which reason the force 61 of the loaded energy storage mechanism 60 acting on it cannot be unloaded. When the energy storage mechanism 60 is under maximum load, the storage lever 40 is in its end pivot position.

If we assume the closed position of the rotary catch shown in FIG. 1, in which the motor vehicle door is closed, then, to open the door, a handle (not shown) must be operated. This can be done either mechanically or preferably electrically, as in the present case. This handle is integrated into the previously mentioned control logic circuitry. A handle such as this can be switched by electric or mechanical means between a functional state and an nonfunctional state. In the case of a lock cylinder, for example, this can be done from the outside of the door by turning a key or from the inside of the door by actuating a locking bar, the components in the lock cylinder being moved between a so-called "secured" position and an "unsecured" position or even a so-called "super-secured" position. This principle could also be used in the present rotary catch lock. But there are also other possibilities, e.g., electronic means, which the user must use to prove that he/she is "authorized" to open the vehicle door. Once the user has proven his/her right to access, the handle can be made functional mechanically or, as previously stated, electronically. The handle can now be operated successfully and, as will be explained in greater detail on the basis of FIG. 11, the motor 50, which is initially at rest, will start to operate in forward drive, as illustrated by the motion arrow 56.

Figure 10:
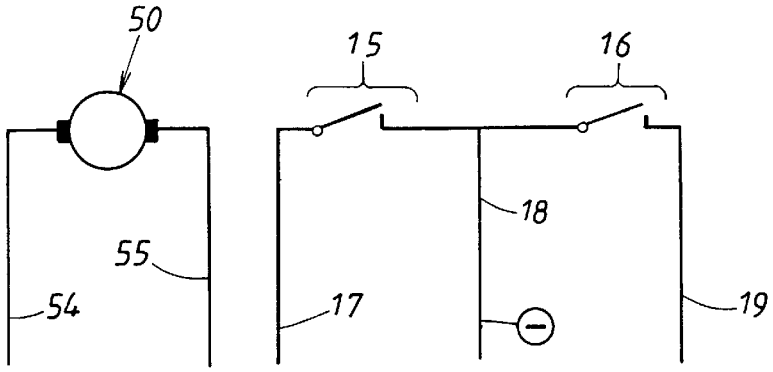
FIG. 10 shows a schematic circuit diagram of some of the electrical components of the lock shown in FIGS. 1–9.
Figure 11:
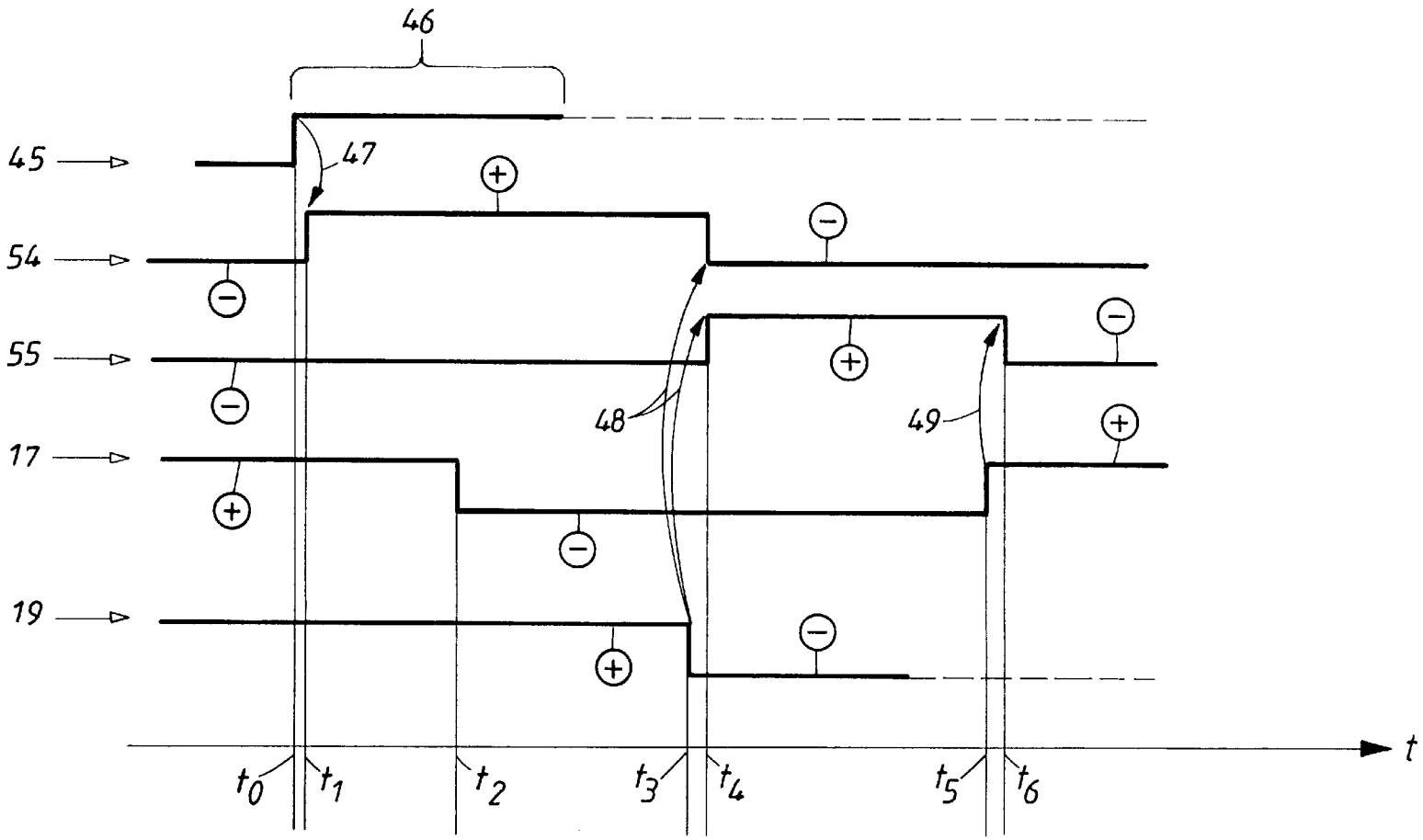
FIG. 11 shows a control diagram of the electrical circuit shown in FIG. 10, from which it is possible to derive the changes in voltage over time and their relationships as established by circuit logic.

As indicated by the circuit shown in FIG. 10, only five pins are needed for electrical control; these pins are represented by the previously mentioned lines 54, 55, and 17–19. FIG. 11 shows, as a function of time, the electrical drives at four of these pins 54, 55, 17, 19 along the time axis t shown in the drawing. The fifth pin 18 is not shown in the control program of FIG. 11, because, as FIG. 10 shows, it is under a negative voltage at all times. The curve 45 at the top is the control curve of the handle. The operation of the handle acts on the control logic.

In FIG. 11, the handle is operated at time t, which generates a pulse 46, clearly marked on the course of curve 45, the length of which depends on the duration of operation. At t0, the control logic responds to the start of the pulse triggered by the handle and reverses the potential of pin 54, which had been negative until then, as indicated in FIG. 11, to positive at time t1. The time difference between t0 and t1 is only a few microseconds. This reversing effect which the handle, as represented by control curve 45, exerts on pin 54 via the control logic is illustrated in FIG. 11 by an action arrow 47.

At time t1, as shown in FIG. 11, the two pins 54, 55 are now at different potentials, because the other pin 55 of the motor 50 remains at a negative potential. As a result, the motor 50 starts to operate, and the forward driving 56 already mentioned in connection with FIGS. 1 and 2 begins. During this forward motion 56, the tappet 51, as can be seen in FIGS. 1 and 2, slides along the inside edge of the storage lever 40, which is provided with a suitable control section 41. This control section 41 has a beginning portion which is circular and conforms to the rotational path of the tappet 51 on the worm wheel 53; for this reason, the storage lever 40 does not move at first even though the stored force 61 is acting upon it. As the forward motion 56 continues, however, tappet 51 arrives at areas of the control section 41 which extend in a more nearly radial direction, for which reason the stored energy 61 can now be used to pivot the storage lever 40 increasingly in the direction of arrow 43 and thus toward the third working arm 31.

In the closed position of the rotating catch 20 of FIG. 1, the lever sensor 16 is in the position shown in FIG. 10, i.e., the position in which the electrical contacts are disconnected. This means that microswitch 16 is open. In the exemplary embodiment of FIG. 1, it is the outside edge 42 of the storage lever 40 opposite control section 41 which takes care of doing this. Alternatively, this could also be done by a control projection 57 provided on the worm wheel 53, as indicated in dash-dot line in FIG. 1; in the starting rotational position, this control projection keeps the actuating element on lever sensor 16 pushed in. The position of the switch of the lever sensor 16 can be determined by the motor drive acting through the worm gear 53 with a very high degree of precision. The starting rotational position of worm wheel 53 can also be determined by a stationary rotation stop 58 in the lock housing 11, against which a radial finger 59 projecting from on worm wheel 53 can strike. This stop action at 58, 59 is not absolutely necessary, however. It would also be possible to provide a space here, as it would be in the normal case, which avoids the creation of noise during the control movements of the components. As FIG. 11 shows, the two pins 54, 55 of the motor are at the same negative level in the period of time before t0; the electrical lines of the motor are short-circuited, for which reason the motor does not turn.

The pivoting motion 43 of the storage lever 40 comes about as a result of the unloading of the energy storage mechanism 60, whereas the tappet 51 controls this pivoting motion 43 only in a "braking" manner as it is driven forward 56. FIG. 2 shows that, during this pivoting motion 43, the actuating element of the lever sensor 16 will ultimately be released, which is shown in FIG. 11 to occur at time t2. Pin 17 of the circuit in FIG. 10, which up until now has been at a positive potential, arrives at the negative level of pin 18, which now leads to further effects.

In FIG. 2, contact has occurred at point 35 between the two parts 30 and 40. Whereas up to now the tappet 51 has prevented the stored energy 61 of energy storage mechanism 60, which acts on control lever 40, from acting on the latch 30 as well, the stored energy 61 is now transferred via contact point 35 to the working arm 31 of the latch, and the adjusting arm 32 is thus pivoted in the direction of the pivot arrow 36 shown in FIG. 3. This means that the working arm 31 of the latch, which until now has been resting against the main catch flank 24 of the rotary catch 20, becomes gradually disengaged. Disengagement has just occurred in the pivot position of the latch 30 shown in FIG. 3; the working arm 31 of the latch 30 has released the catch, for which reason the catch is now able to rotate further in the direction of its open position of FIG. 5. In FIG. 3, the actuating element of the catch sensor 15 is still being pressed in by a suitable rotary catch control section 26, and therefore the contacts of the sensor are still being held in the open position, as indicated in FIG. 10; that is, a positive potential is present at pin 19 of the circuit of FIG. 10, as can be seen from the curve at the bottom of the control diagram of FIG. 11. This action of the control section 26 was also present, of course, in the preceding illustrations of FIGS. 1 and 2.

This situation does not change until the limit position is reached, shown in solid line in FIG. 4. The rotary catch 20 has now turned to such an extent under the action of its restoring force 22 that the actuating element of the catch sensor 15 is released by the associated control section 26. The closing of the contact of the catch sensor 16 in FIG. 10 puts pin 19 at the negative potential of pin 18, which corresponds to time t3 in the control program of FIG. 11. In FIG. 4, the latch 30 has already arrived in its end pivot position under the action of the stored energy 61, for which reason the latch 30 and the storage lever 40 remain at rest for the time being. Up until time t3, the tappet 51 has been rotating in the direction of arrow 56 and has thus broken contact with the storage lever 40.

The control logic of the rotary catch lock responds to the reversal of the catch sensor 15 at time t3 of FIG. 11 and, after a short reaction time, namely, at time t4 of FIG. 11, puts the two pins 54, 55 of the motor 50 at mirror-image potentials. This is indicated by the two action arrows 48 of FIG. 11. Thus pin 54 is switched to a negative potential and pin 55 to a positive potential. This has the result that the motor 50, which up to now has been driving forward, brakes as a result of the opposite voltages. This change occurs at the rotational position which the tappet 51 has just reached in FIG. 4. At this point, however, the motor starts to rotate in the opposite direction, so that now the motor begins to drive in reverse and thus the tappet 51 also starts to moves backwards, as indicated by rotation arrow 56' in FIGS. 4 and 5. In the meantime, the restoring force 22 acting on the rotary catch 20 rotates the catch to its fully open position, illustrated in dash-dot line in FIG. 4, which allows the door of the vehicle to be opened. Closing element 10 can leave its radial cutout 23 in the catch 20; the opening movement illustrated by the arrow 13' in FIG. 4 occurs, which allows the closing element to reach its release position 10'.

With the vehicle door open, the rotary catch 20 in FIG. 5 is still in the open position, which is determined by the previously mentioned stop 12. During this time, however, the motor has continued to move tappet 51 backwards in direction 56'. The tappet 51 meets the control section 41 of the storage lever 40 again and pivots the lever back in the direction of pivot arrow 43' of FIG. 5. As a result, the motor works in the direction opposite that of the stored energy 61, and the loading of the energy storage mechanism 60 begins. The motor 50, however, does not need to perform any other work during this reverse driving 56', for which reason all of the motor's energy can be used to load the energy storage mechanism 60. The latch 30 remains at rest, even though the previously mentioned spring force 33 is acting on it, as also shown in FIG. 5. This reason for this is that the working arm 31 of the latch has a locking tooth 37, which rests against the previously mentioned control section 26 of the rotary catch 20. The spring force 33 exerted by the latch 30 therefore presses the locking tooth 37 elastically against the control surface 26. The spring-loaded latch is thus now in its "stand-by position" as shown in FIG. 5 and also in FIG. 6. Even though its locking tooth 37 wants to pass radially into the appropriate flank of the rotary catch 20, it is initially prevented from doing so at this point by the control section 26 on the catch.

In FIG. 6, the reverse motion 56' of the tappet 51 has pushed storage lever 40 back into its starting position as shown in FIG. 1. As a result, the actuating element on the associated lever sensor 16 is actuated. As already mentioned in conjunction with FIG. 1, the outside edge 42 of the storage lever accomplishes this actuation in the exemplary embodiment; alternatively, however, it would also be possible to use a control projection 57 seated nonrotatably on the worm wheel 53. When lever sensor 16 is actuated, its contacts open again, as can be seen in FIG. 10. The connection to pin 18 is interrupted, and pin 17, as can be seen at time t5 in the next-to-last curve, is again at a positive potential. This change in voltage is evaluated by the control logic, and after a short reaction time, the potential at pin 55 of motor 50 also changes, namely, at time t6 of FIG. 11. This effect of the control logic is illustrated in FIG. 11 by an action arrow 49. Pin 55 thus assumes a negative potential, as shown by the control program of FIG. 11. The two pins 54, 55 belonging to the motor 50 therefore again have the same potential, namely, a negative one, for which reason the motor 50 is short-circuited and brakes. The motor thus comes to an exact stop without any need for the action of mechanical end stops.

FIG. 6 shows an end situation of this type with the door open. The energy storage mechanism 60 is now fully loaded again, so the maximum amount of stored energy 61 is available. While storage lever 40 is in its starting position, which is also present when the door is closed, the latch 30 is in its previously described stand-by position as long as the closing element is in its release position 10' outside the rotary catch 20. If, while the door remains open, the handle is actuated again by mistake, the control logic ensures that the motor 50 remains idle. The control logic detects this on the basis of the fact that the catch sensor 15 of the catch 20 has not been actuated.

As FIG. 6 illustrates, the spring force 33 acting on the latch 30 can be achieved by means of a spring element 27, which acts between the latch 30 and the storage lever 40. A two-shank torsion spring can be used for this, which is attached to the common axle 34 of the latch 30 and the storage lever 40 and which, with its two shanks 28, 29, tries to push the working arm 31 of the latch and the storage lever 40 toward each other. The two components 40, 31 are prevented from approaching each other, however, because the storage lever 40 rests against the tappet 51 and the latch 30 rests against the control section 26 on the catch. Of course, the latch 32 could obtain the elastic force 33 described above from its own spring. The energy storage mechanism 60 acting on the storage lever 40 is indicated only schematically in the drawings; in an actual case, it could consist of a two-shank spring, one end of which is supported against the housing, while the other end transfers the stored energy 61.

This latter situation does not change until the door is to be closed, which means that the closing element 10' now moves in the direction of closing motion arrow 13 of FIG. 6 and pushes against the flank 24 in the radial cutout 23 in the rotary catch 20. The closing element thus rotates the catch back again against the restoring force 22. As a function of the extent to which the catch is rotated, the latch 30, which is in its stand-by position, can now engage either with flank 25 of the pre-catch or with flank 24 of the main catch and thus arrive in either the previously mentioned pre-catch position or the final closing position shown in FIG. 1. Thus the working cycle is completed.

As can be derived from FIGS. 1–6, the tappet 51 moves back and forth in the space, designated 44 in FIG. 6, between the storage lever 40 and the latch adjusting arm 32 during the forward and reverse driving 56, 56' of the motor. Thus, during forward driving 56, there is only a passive adjusting movement of the tappet 51 on storage lever 40 and no interaction between the tappet 51 and the latch 30. There is active interaction between the tappet 51 and the control section 41 on the storage lever only during the reverse pivoting motion 43' illustrated in FIG. 5. This applies, however, only to the normal case described in FIGS. 1–6 and not to the special case now to be explained on the basis of FIGS. 7–9.

Figure 7:
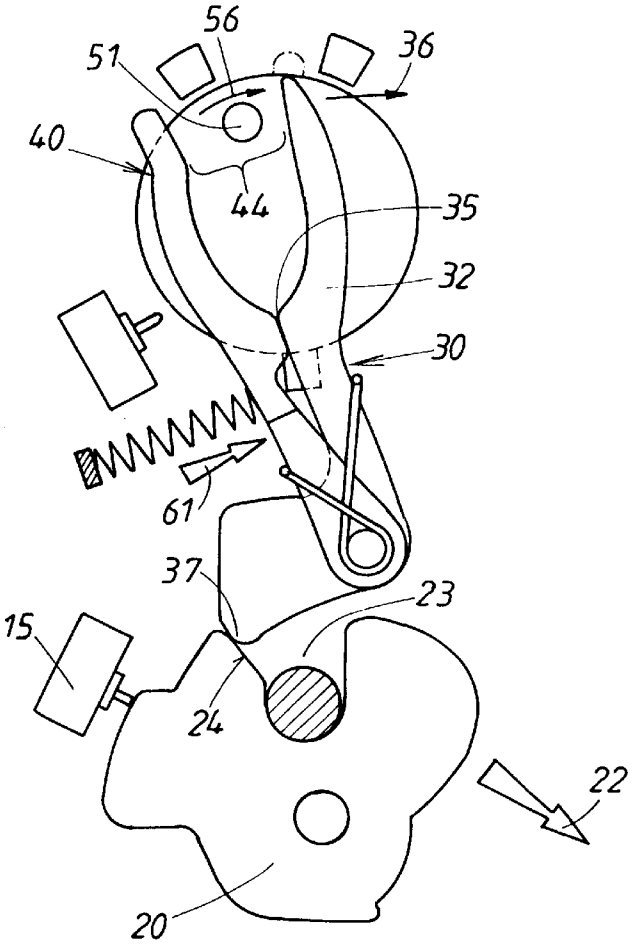
FIG. 7 shows an operating position of the lock according to the invention comparable to that of FIG. 2 except that a crash or the like has made it difficult for the latch to move.

The special case shown in FIG. 7 represents a rotational position of the rotary catch which corresponds to the relationships of the normal case described in FIG. 2. The only difference is that it is now difficult for the latch adjusting arm 32 to execute its pivoting motion 36, which could be the result of a crash, for example, in which the motor vehicle was involved. The friction between the locking tooth 37 of the latch 30 and the flank 24 in the cutout 23 of the catch 20 is so great that the stored energy 61 acting on the storage lever 40 described in conjunction with FIG. 2 is not strong enough to disengage the latch 30 from the rotary catch 20 by way of the contact point 35. Even if, in spite of the opening forces 22, 61 acting upon them, the components 20, 40, and 30 are initially immobile in this special case, the motor can still continue to move the tappet 51 in the intermediate space 44. It can be seen in FIG. 7 that, as a result of its forward movement 56, the tappet 51 has left the storage lever 40 and is now approaching the latch adjusting arm 32.

Figure 9:
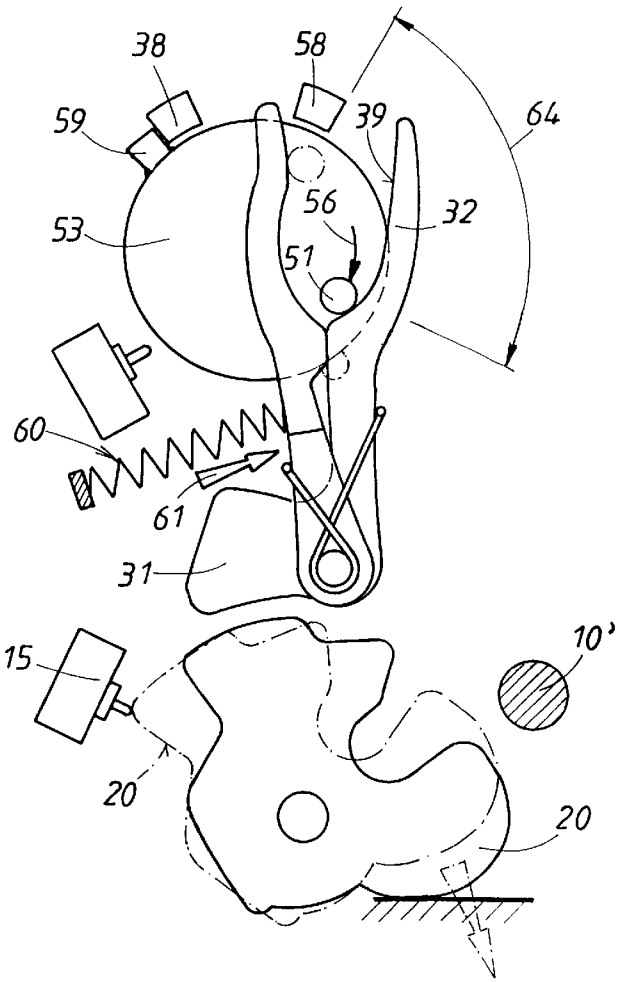
FIGS. 8 and 9 show two additional working positions of the components in the special situation of FIG. 7.
Figure 8:
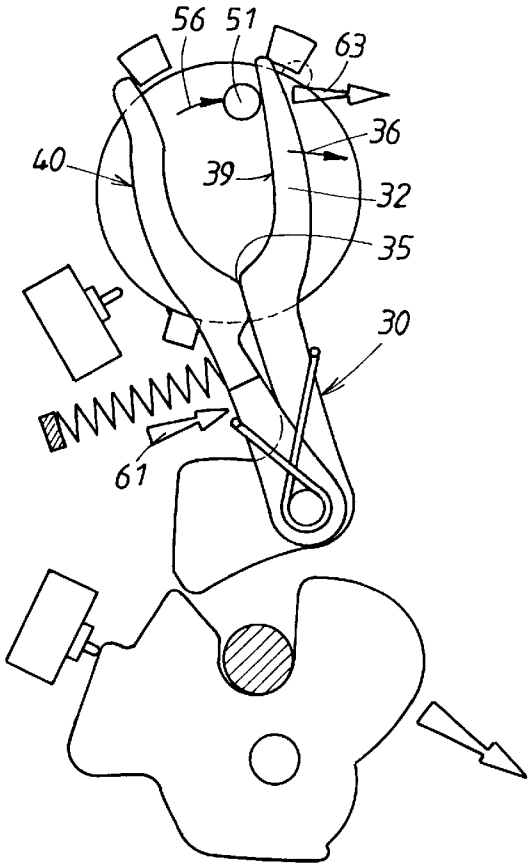

In FIG. 8, a limit situation has just been reached in which the continued forward movement 56 of the tappet 51 has led to contact between the tappet and the control section 39 on the inside edge of the latch adjusting arm 32. The tappet then proceeds along this edge, as can be seen in FIG. 9. As this rotational movement 56 continues, the tappet 51 exerts an additional opening force 63, shown in FIG. 8, which is added to the stored energy 61 exerted by the storage lever 40 via the contact point 35. The energy now available, which is practically double the original amount, is sufficient to overcome the jamming of the components and to bring about the desired pivoting motion 36 of the latch 30.

This successful result is illustrated in FIG. 9. The working arm 31 of the latch has left the original position of the rotary catch illustrated in dash-dot line and has arrived under the action of its restoring force 22 in its open position, shown in solid line. The closing element can now be moved into its release position 10'.

FIG. 9 illustrates relationships which are similar to those of the normal case presented in FIG. 4. The agreement consists namely in that, in both FIGS. 9 and 4, the actuating element of the catch sensor 15 has been released and that therefore at this point the motor begins to operate in reverse, with backward rotation 56, as already described in conjunction with FIG. 5. A comparison, however, shows that, in the special case of FIG. 9, the motor has driven the worm wheel 53 forward over a much greater angular range 64 than in the situation of FIG. 4 corresponding to the normal case. This angle 64 means that a correspondingly greater amount of energy has been consumed by the motor 50 to open the difficult-to-move rotary catch 20 in the special case. A comparison of FIGS. 4 and 9 also shows that, in the special case of FIG. 9, the energy storage mechanism 60 has also been unloaded to a much greater extent and that therefore additional stored energy 61 has also been supplied to open the rotary catch 20. All this is possible while making only modest demands on the energy to be supplied by the motor 50; the motor can therefore have a low power rating and will thus occupy only a modest amount of space.

The end position of the forward driving 56 of the tappet 51 shown in FIG. 9 can also be defined by the action of an additional rotation stop 38. The finger 59 on worm wheel 53, already mentioned in conjunction with FIG. 1, has made contact with its rotation stop 38 and thus stops the motor 50 from turning under any possible circumstances. As a support measure, the control logic can also respond to this stop situation, which it detects by electrical means, i.e., from the increase in the amount of power drawn by the motor after contact has been made with the stop. At this point, the motor 50 will always begin to operate in reverse, and thus the tappet 51 will also begin its reverse operation 56', as previously described in conjunction with FIGS. 4 and 5; in this special case, too, the tappet ultimately brings the latch 30 into the stand-by position of FIG. 6 with the rotary catch 20 in the open position, in the same way as in the normal case. As this is happening, the energy storage mechanism 60 becomes loaded again. In the special case of FIG. 9, the angular range around which this charging occurs is larger than that of the reverse driving 56' described in FIG. 5.

LIST OF REFERENCE NUMBERS

10 closing element (while being held in 20)
10' release position of 10
11 lock housing
12 stop for 20
13 arrow of the closing motion between 10' and 10
13' arrow of the opening motion between 10 and 10'
14 central plug at 11
15 first sensor, catch sensor
16 second sensor, lever sensor
17 line from 15, pin
18 line from 15 and 16, pin
19 line from 16, pin
20 rotary catch
21 axle of 20
22 arrow of the restoring force acting on 20
23 radial cutout in 20, receptacle for 10
24 flank in 23, main catch
25 pre-catch flank on 20
26 control section on 20 for 15 and 37
27 spring element between 30 and 40
28 first shank of 27
29 second shank of 27
30 latch
31 working arm of 30
32 adjusting arm of 30
33 arrow of the spring force acting on 30
34 axle for 30 and 40
35 contact point between 31 and 40
36 arrow of the pivoting motion of 31
37 locking tooth on 31
38 second rotation stop for 59 (FIG. 9)
39 control section on 32 (FIGS. 8, 9)
40 storage lever
41 control section on 40
42 outside edge of 40
43 arrow of the pivoting motion of 40
43' arrow of the reverse pivoting motion of 40
44 intermediate space between 32 and 40
45 course of the voltage curve upon operation of the handle (FIG. 11)
46 pulse upon operation of the handle (FIG. 11)
47 action arrow between 45 and 54 at t0/t1 (FIG. 11)
48 two action arrows between 19/54 and 19/55 at t3/t4
49 action arrow between 17/55 at t5/t6
50 direct-current motor
51 tappet
52 gear component, worm
53 gear component, worm wheel
54 first line of 50, pin
55 second line of 50, pin
56 arrow of the forward driving of 51
56' arrow of the reverse driving of 51
57 alternative control projection on 53
58 first rotation stop for 59
59 finger on 53
60 energy storage mechanism
61 stored energy of 60
62 stationary end of spring 60
63 motor-generated opening force at 32 (FIG. 8)
64 angular range of the further rotation of 51 in the special case (FIG. 9)
t time axis
t0 time at which handle is operated
t1 time at which forward driving 56 of 50 begins
t2 time at which 16 closes
t3 time at which 15 closes
t4 time at which reverse driving 56 of 50 begins
t5 time at which 16 opens
t6 time at which reverse driving 56 of 50 ends

What is claimed is:

1. A rotary catch lock between a movable part and a stationary part of a door, a flap, or a hood of a motor vehicle, comprising:

a closing element (10) on a first one of the movable and stationary parts;

a rotary catch (20) on a second one of the movable and stationary parts;

wherein the rotary catch (20) is rotatable between a closed position and an open position and is configured to receive the closing element (10) in the closed position;

wherein the rotary catch (20) is held by a pivoting latch (30) loaded by a spring force (33) against a restoring force (22), wherein the restoring force (22) is configured to push the rotary latch (20) into the open position, wherein the rotary catch (20) releases the closing element (10) when the rotary catch is in the open position;

an electrically driven motor (50);

an energy storage mechanism (60);

wherein the pivoting latch (30) is movable from a blocking position, in which the rotary catch (20) is held, to a stand-by position, in which the rotary catch (20) is released, wherein the pivoting latch (30) rests against the rotary catch (20) in the stand-by position;

a pivotable storage lever (40) configured to transfer stored energy of the energy storage mechanism (60) to the pivoting latch (30) in order to pivot the pivoting latch (30) into the release position, wherein a transfer of the stored energy occurs at least during a final phase of pivoting of the pivoting latch (30) by unloading the stored energy from the energy storage mechanism (60);

a tappet (51), rotationally driven by the motor (50), wherein the storage lever (40) rests against the tappet (51) when the pivoting latch (30) is in the stand-by position and during an initial phase of pivoting of the storage lever (40);

wherein the motor (50) is configured to be driven in rotation by an electronic control logic in a forward direction (56) to a first end position to allow the storage energy of the energy storage mechanism (60) to be unloaded, wherein during rotation in the forward direction (56) the tappet (51) follows or supports pivoting of the pivoting latch (30) by being acted on by the storage lever (40); and wherein the motor (50) is configured to be driven in rotation by electronic control logic in a reverse direction (56') to a second end position relative to the forward direction (56) to reload the energy storage mechanism (60), wherein during rotation in the reverse direction (56') the tappet (51) releases the pivoting latch (30), moves toward the storage lever (40), and moves the storage lever (40) into a starting position corresponding to the stand-by position of the pivoting latch (30).

2. The rotary catch lock according to claim 1, wherein the tappet (51) is positioned in a space (44) provided between the storage lever (40) and an adjusting arm (32) of the pivoting latch (30) and is driven rotationally back and forth in the space (44) between the storage lever (40) and the adjusting arm (32) when the motor (50) rotates in the forward and reverse directions (56, 56').

3. The rotary catch lock according to claim 1, comprising a lock housing (11) having a common axle, wherein the storage lever (40) and the pivoting latch (30) are supported pivotably on the common axle of the lock housing (11), wherein the storage lever (40) and the latch (30) are configured to pivot separately at least during some phases of operation.

4. The rotary catch lock according to claim 1, wherein the spring force (33) acts simultaneously on the pivoting latch (30) and the storage lever (40) so as to push the pivoting latch (30) and the storage lever (40) toward each other.

5. The rotary catch lock according to claim 1, comprising a catch sensor (15) monitoring a rotational position of the rotary catch (20) and responding to the rotational position when the rotary catch (20) has moved out of the closed position so far that the pivoting latch (30) no longer prevents the rotary catch (20) from turning into the open position, and wherein the catch sensor (15) responds by acting on the control logic to activate the motor (50) for rotation in the forward direction (56).

6. The rotary catch lock according to claim 2, comprising a lever sensor (16) monitoring a position of the storage lever (40) or tappet (51) and responding to the position of the storage lever (40) or tappet (51) when the tappet (51) reaches a starting position corresponding to the stand-by position of the pivoting latch (30) by being acted on by the motor (50) rotating in the reverse direction (56'), and wherein the lever sensor (16) responds by acting on the control logic to stop the motor (50) from rotating in the reverse direction (56').

7. The rotary catch lock according to claim 1, comprising rotational end stops (58, 38), wherein the first and second end positions of the motor (50) are limited by the rotational end stops (58, 38).

8. The rotary catch lock according to claim 7, wherein the motor (50) has gears (52, 53) and wherein the rotational end stops (58, 38) are configured to limit rotational movement of the gears (52, 53).

9. The rotary catch lock according to claim 1, wherein the rotary catch (20) has an intermediate position between the closed position and the open position, wherein the intermediate position is a pre-catch position, wherein in the pre-catch position the closing element (10) is received in the rotary catch (20).

* * * * *